US005191166A

United States Patent [19]

Smirlock et al.

[11] Patent Number: 5,191,166

[45] Date of Patent: Mar. 2, 1993

[54] SURVIVABILITY ENHANCEMENT

[75] Inventors: Martin E. Smirlock, Concord; Robert C. Sykes, Burlington; Anthony L. Alesi, Wayland; Joseph J. Prifti, Arlington, all of Mass.

[73] Assignee: Foster-Miller, Inc., Waltham, Mass.

[21] Appl. No.: 712,935

[22] Filed: Jun. 10, 1991

[51] Int. Cl.[5] ..... F41H 5/013; F41H 5/04

[52] U.S. Cl. ..... 89/36.02; 109/49.5

[58] Field of Search ..... 89/36.02, 36.01, 36.08, 89/36.13, 36.07; 428/911; 109/49.5

[56] References Cited

U.S. PATENT DOCUMENTS

| | | | |
|---|---|---|---|
| 3,592,942 | 7/1971 | Hauck | 89/36.02 |
| 3,643,177 | 1/1972 | Glaser | 89/36.02 |
| 3,702,593 | 10/1972 | Fine | 89/36.02 |
| 3,729,372 | 4/1973 | Matchen | 89/36.02 |
| 3,730,826 | 5/1973 | Matchen | 89/36.02 |
| 3,730,827 | 5/1973 | Matchen | 89/36.02 |
| 3,793,648 | 2/1974 | Dorre | 2/2.5 |
| 3,977,294 | 8/1976 | Jahn | 428/911 |
| 4,355,562 | 10/1982 | Sewell | 109/84 |
| 4,404,889 | 9/1983 | Miguel | 428/911 |
| 4,545,286 | 10/1985 | Fedij | 109/81 |
| 4,704,943 | 11/1987 | McDougal | 89/36.02 |
| 4,768,418 | 9/1988 | Bloomer et al. | 89/34 |
| 4,813,334 | 3/1989 | Bloks | 89/36.02 |
| 4,824,624 | 4/1989 | Palicka | 109/49.5 |
| 4,876,841 | 10/1989 | Barnes | 89/36.02 |
| 4,928,575 | 5/1990 | Smirlock et al. | 89/36.02 |
| 4,989,493 | 2/1991 | Bloomer et al. | 89/36.02 |

*Primary Examiner*—Stephen M. Johnson

*Attorney, Agent, or Firm*—Fish & Richardson

[57] ABSTRACT

An applique armor system includes a plurality of armor tiles, each armor tile being a composite armor member with a sheet ceramic armor component, an impedance match enhancing sheet member of material such of metal or polymer material adhered to the surface of the ceramic sheet member remote from the anticipated direction of attack, and a compliant separable fastener component of extended area type secured to a surface of the composite armor tile, the ceramic sheet member preferably having a thickness at least ten times the thickness of the impedance match enhancing sheet member.

19 Claims, 1 Drawing Sheet

SURVIVABILITY ENHANCEMENT

Figure 1A:
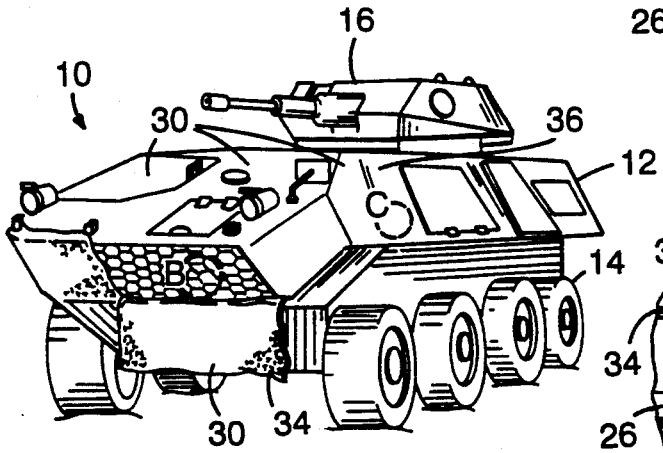

This invention relates to survivability enhancement. It is frequently desirable to enhance the survivability of various structures, including fixed and movable structures, and depending on particular applications, survivability enhancement structure may be places on internal or external surfaces, or both, of the structure whose survivability it is desired to enhance.

In particular applications, survivability enhancement structures are applied to external surfaces of the vehicle or system. Armored vehicles, for example, are designed to provide ballistic protection commensurate with a specific threat. In connection with such vehicles and systems, the ability to readily vary the ballistic protection configuration or to quickly repair damaged armor as a function of particular threats to which the vehicle or system may be exposed may enhance survivability. Applique armor, that is - - - supplemental armor applied on top of the basic armor designed into the vehicle or system, has been proposed to enhance survivability. It has been proposed to attach such applique armor to the basis armor by adhesive bonding, by mechanical bolting, and by mechanical attachment. U.S. Pat. No. 4,928,575 describes a system employing separable fastener structure for attaching applique armor to basis armor.

Such separable fastener structure arrangements have effective force dissipation characteristics and maintain attachment at effective levels even as the survivability enhancement structure is subjected to large shear forces (for example, upon ballistic impact and shattering of an adjacent tile or flexing of an armor sheet member). Such systems enable easy installation of auxiliary armor structure, as well as easy removal and reapplication to facilitate future armor revisions and upgrades. Easy replacement of damaged armor members in the field is possible. The structural integrity of the attachment system withstands normal system shocks, vibrations, brush loads, etc. However, the compliantly mounted ceramic armor tiles tend to require greater thicknesses (and accordingly, increased weight) to provide armor effectiveness comparable to rigidly mounted applique armor of the same material.

In accordance with one aspect of the invention, there is provided an applique armor system that includes a plurality of armor tiles, each armor tile being a composite armor member with a sheet ceramic armor component, an impedance match enhancing sheet member of material such of metal or polymer material adhered to the surface of the ceramic sheet member remote from the anticipated direction of attack, and a compliant separable fastener component of extended area type secured to a surface of the composite armor tile, the ceramic sheet member preferably having a thickness at least ten times the thickness of the impedance match enhancing sheet member.

Preferably, the separable fastener component on the armor tile cooperates with a second type of separable fastener component, one of the fastener components having a multiplicity of hooking elements and the other separable fastener component having complementary structure for releasable interengagement with the hooking elements. Preferably each hooking element includes a flexible stem portion and a head portion, the head portion including a laterally projecting inclines deflecting portion and a latch surface located between the deflecting surface portion and the stem portion for engaging a portion of the cooperating fastener structure in fastening relation. While the hooktype fastener elements may be of a variety of materials, including metals, in particular embodiments, the base portion and hook elements are of a thermoplastic polymeric material such as nylon, polypropylene or the like, and the base portion of that fastener structure is bonded with an epoxy adhesive or the like on the surface to which it is secured. In particular embodiments, the cooperating fastener structure includes a multiplicity of loop elements which may be formed from nylon fibers, metal wire or the like, the loops being releasably interengageable with the projecting hooking elements of the other fastener structure. Depending on the particular application, either the loop element structure or the hooking element structure may be on the composite armor member with the cooperating releasable fastener structure on the structure whose survivability is to be enhanced. The engaged hook and loop fasteners space the composite armor member at least about one millimeter from the support surface on which the composite armor member is mounted.

In particular embodiments, the ceramic armor material is selected from the group of boron carbide, silicon carbide, aluminum oxide, titanium diboride and cermets that include such a ceramic; and the tensile strength of the impedance match enhancing material is at least ten times the tensile strength of the ceramic armor material. In particular embodiments, each composite member has opposed planar surfaces, is in the range of one half to five centimeters thick, and is of polygon configuration with perimeter edge surfaces at least about four centimeters long; and the impedance match enhancing sheet member is co-extensive with the ceramic component and has a thickness of less than one millimeter.

While the reasons for enhanced armor effectiveness of compliantly composite armor system in accordance with the invention are not entirely clear, it is believed that the high tensile strength impedance match enhancing sheet tends to reduce the impedance mismatch between air and the ceramic armor material, allowing greater transmission of the shock wave generated by the projectile with reduced stress at the ceramic boundary, and transferring tensile stress to the interface of the reinforcing sheet and the compliant fastener.

Figure 1B:
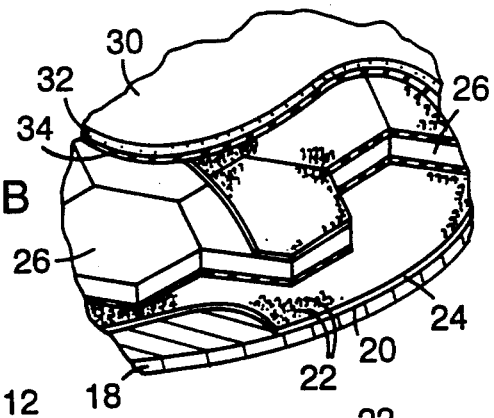
Figure 1C:
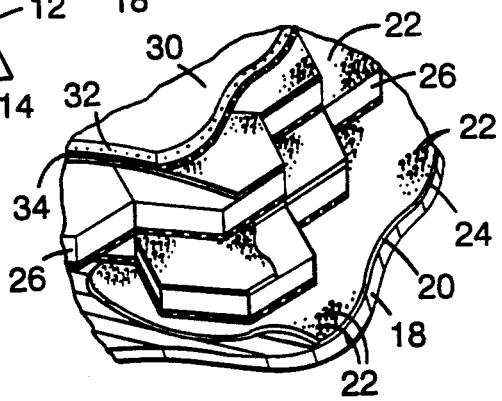
Figure 2:
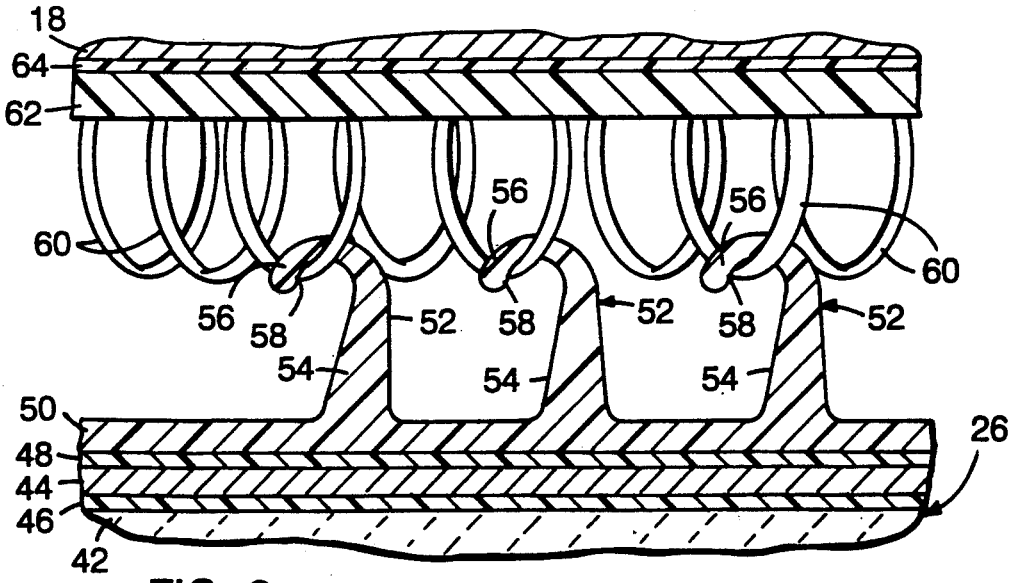

Other features and advantages of the invention will be seen as the following description of particular embodiments progresses, in conjunction with the drawing, in which:

FIG. 1A is a view of a light armored vehicle that incorporates survivability enhancement in accordance with the invention, the enlarged views of FIGS. 1B and 1C illustrating particular configurations of survivability enhancement systems in accordance with the invention; and FIG. 2 is a sectional diagrammatic view of an enlarged portion of a fastened armor tile in accordance with the invention.

DESCRIPTION OF PARTICULAR EMBODIMENTS

Shown in FIG. 1 is a lightweight, high-mobility vehicle 10 that includes hull 12 mounted on a series of driven wheels 14, and turret 16 on hull 12. Hull 12 is constructed of one quarter inch thick steel armor plate 18, and has fastener structure 20 on the outer surface of hull 12. Fastener structure 20 may be of the hook type 22 as shown in FIG. 1 or of cooperating loop type 24 shown in FIG. 2. Applique armor in the form of an array of composite tiles 26 with cooperating fastener structure 28 secured thereto is compliantly fastened to hull 12 in manner similar to the system shown in U.S. Pat. No. 4,928,575, the disclosure of which is expressly incorporated herein. Overlying fastener structure 20 is flexible cover sheet 30 which provides signature reduction (such as modified reflectivity to electromagnetic radiation, infrared radiation, or the like). Cover sheet 30 includes a silicone rubber substrate in which particulate signal reduction material 32 is embedded, sheet 30 having a thickness of about six millimeters. Secured on the inner surface of cover 30 by a suitable adhesive is fastener structure 34 which includes an array of loop elements 24 of polymeric material, the loops having heights of about three millimeters. Hook elements 22 of fastener structure 20 may be engaged with loop elements 24 of cover 30. One or more layers of armor tiles 26 may be interposed between hull 12 and cover 30, a single layer of armor tile 26 being provided in side region 36 as indicated in FIG. 1B and a double layer of armor tile 26 being provided in front region 38 as indicated in FIG. 1C.

Each composite tile 26 is of about two centimeters thickness and has a hexagonal configuration with each straight edge section of the perimeter of the tile having a length of about eight centimeters.

As indicated in FIG. 2, each tile 26 includes ceramic sheet member 42 of alumina of about two centimeters thickness, steel sheet 44 of about 0.25 millimeter thickness that is secured to alumina member 42 with epoxy adhesive 46; and hook-type fastener structure 22 secured to metal sheet 44 with bonding agent 48.

As indicated in FIG. 2, fastener structure 22 includes base portion 50 and an array of hook elements 52, each of which includes flexible stem portion 54, deflection surface 56 and latch surface 58. It will be apparent that other hooking element configurations (or arrow or spear shape, for example) may be employed. Hook elements 52 are of about 0.7 millimeter height and base 50 is of about 0.3 millimeter thickness. Cooperating separable fastener structures 24 are loop elements 60 (of nylon filament, metal wire or the like) (of about 1.5 millimeter height) secured to base sheet 62 (of about 0.5 millimeter thickness) that in turn is secured to hull 12 with bonding agent 64. In attached relation as indicated in FIG. 2, steel sheet 44 is compliantly spaced about three millimeters from hull 18.

The holding force of the survivability enhancement fastener system is a function of the configuration, density and material of the hook elements 52 as well as the size, number and material of the loop elements 60. In a particular embodiment, the fastener structures 20, 28 in attached relation, have a tension restraint of about seven psi for a total of about 180 pounds over the twenty-six square inch area of an individual tile 22; a shear restraint of approximately fifteen psi or a total of about 390 pounds over the twenty-six square inch area of a tile 22; and are removable by manually applied tension force.

The following particular embodiments, the hook fastener structure 22 was of injection molded nylon with an integral base 50 and a hook height of about two thirds millimeter and an overall height of about one millimeter, the fastener structure 22 being secured to an armor member. The loop elements 24 were of 200 denier nylon and had a height of about two millimeters and were secured to base 62 of about one half millimeter thickness that in turn was secured to the steel sheet 44 of the composite tile member 26.

In one of those embodiments, a cermet armor material of silicon carbide, aluminum and alumina of 3.25 grams per cubic centimeter density with separable fastener compliant mounting was shot with an 830 grain fragment simulating projectile with a resulting V50 estimated value of 3,100 feet per second. The same cermet armor material with an impedance match enhancing steel sheet 44 of 0.25 millimeter thickness with the same separable fastener compliant mounting was subjected to the same ballistic projectile conditions and had a resulting V50 estimated value of 3293 feet per second, an increase in armor effectiveness of about six percent.

In similar tests, 90 percent density alumina with separable fastener compliant mounting but without an impedance match enhancing sheet had a V50 estimated value of 2754 and the same ceramic armor material and mounting with a 0.25 millimeter thick sheet of impedance match enhancing steel as a composite had a V50 estimated value of 3013 feet per second, an increase in an effectiveness of about nine percent without significant increase in weight. Similar tests of the same alumina armor of increased thickness but without an impedance match enhancing sheet required an increase in weight of about eight percent to obtain similar armor effectiveness.

While particular embodiments of the invention have been shown and described, it is not intended that the invention be limited to the disclosed embodiments or to details thereof, and departures may be made therefrom within the spirit and scope of the invention.

What is claimed is:

1. An applique armor system comprising a plurality of armor tiles, each said armor tile including a ceramic component of relatively low tensile strength and an impedance match enhancing sheet component of greater tensile strength then said ceramic component secured to the face of said ceramic component remote from the anticipated attack direction, said ceramic component having a thickness of at least ten times the thickness of said sheet component, a separable fastener component of a first type secured to one face of said composite armor tile for cooperative engagement with a separable fastener component of a second type secured to a surface of structure whose survivability is to be enhanced, one of said separable fastener components having a multiplicity of hooking elements and the other separable fastener component having complementary structure for releasable interengagement with said hooking elements of said one separable fastener component, said armor system having energy absorbing characteristics and providing progressive energy dissipation of energy resulting of impact of a ballistic missile on an armor tile of said plurality of armor tiles.

2. The system of claim 1 wherein said separable fastener structures in attached relation have a shear restraint of at least ten psi, and a tension restraint of at least five psi, and can be manually released by application of manually applied tension force.

3. The system of claim 1 wherein each said armor tile has a thickness of at least one centimeter and is of polygon configuration with perimeter edge surface segments that are at least four centimeters long.

4. The system of claim 1 wherein each said hooking element includes a stem portion and a head portion that projects laterally from one side of said stem portion, said head portion including an inclined deflecting portion and a latch surface located between said inclined deflecting surface portion and said stem portion for engaging a portion of a cooperating fastener structure in fastening relationship.

5. The system of claim 4 wherein said cooperating fastener structure includes a multiplicity of loop elements upstanding from a base member.

6. The system of claim 1 wherein said ceramic component of said armor tile is selected from the group consisting of boron carbide, silicon carbide, aluminum oxide and titanium boride and cermets that include a ceramic of said group.

7. The system of claim 1 wherein said separable fastener components in releasable interengagement compliantly space said armor tile at least about one millimeter from the support surface of the structure whose survivability is to be enhanced.

8. The system of claim 1 wherein said sheet component has a thickness of less than one millimeter and is co-extensive with said ceramic component.

9. The system of claim 8 wherein each said hooking element includes a stem portion and a head portion that projects laterally from one side of said stem portion, said head portion including an inclined deflecting portion and a latch surface located between said inclined deflecting surface portion and said stem portion for engaging a portion of a cooperating fastener structure in fastening relationship, and said cooperating fastener structure includes a multiplicity of loop elements upstanding from a base member.

10. The system of claim 9 wherein said separable fastener structures in attached relation have a shear restraint of at least ten psi, and a tension restraint of at least five psi, and can be manually released by application of manually applied tension force.

11. The system of claim 10 wherein said separable fastener components in releasable interengagement compliantly space said armor tile at least about one millimeter from the support surface of the structure whose survivability is to be enhanced.

12. The system of claim 11 wherein said ceramic component of said armor tile is selected from the group consisting of boron carbide, silicon carbide, aluminum oxide and titanium boride and cermets that include a ceramic of said group, and the tensile strength of said impedance match enhancing material is at least ten times the tensile strength of said ceramic armor material.

13. The system of claim 12 wherein each said arm tile has a thickness of at least one centimeter and is of polygon configuration with perimeter edge surface segments that are at least four centimeters long.

14. The system of claim 1 wherein said sheet component is of metal material and has a tensile strength of at least ten times the tensile strength of said ceramic component.

15. The system of claim 14 wherein each said armor tile has a thickness in the range of one half to five centimeters, and has opposed planar surfaces.

16. An applique armor system comprising a plurality of armor tiles, each said armor tile including a ceramic component of relatively low tensile strength and an impedance match enhancing metal sheet component of tensile strength at least ten times the tensile strength of said ceramic component, said metal sheet component being secured to the face of said ceramic component remote from the anticipated attack direction, said ceramic component having a thickness of at least ten times the thickness of said metal sheet component, said metal sheet component having a thickness of less than one millimeter and being coextensive with said ceramic component, and said ceramic component having a thickness of at least ten times the thickness of said metal sheet component, each said armor tile having opposed planar faces and a thickness in the range of one-half to five centimeters, a separable fastener component of a first type secured to one face of said composite armor tile for cooperative engagement with a separable fastener component of a second type secured to a surface of structure whose survivability is to be enhanced, one of said separable fastener components having a multiplicity of hooking elements and the other separable fastener component having complementary structure for releasable interengagement with said hooking elements of said one separable fastener component, said armor system having energy absorbing characteristics and providing progressive energy dissipation of energy resulting of impact of a ballistic missile on an armor tile of said plurality of armor tiles.

17. The system of claim 16 wherein said separable fastener components in releasable interengagement compliantly space armor tiles at least about one millimeter from the support surface of the structure whose survivability is to be enhanced.

18. The system of claim 17 wherein each said hooking element includes a stem portion and a head portion that projects laterally from one side of said stem portion, said head portion including an inclined deflecting portion and a latch surface located between said inclined deflecting surface portion and said stem portion for engaging a portion of a cooperating fastener structure in fastening relationship, and said cooperating fastener structure includes a multiplicity of loop elements upstanding from a base member.

19. The system of claim 18 wherein said ceramic component of said armor tile is selected from the group consisting of boron carbide, silicon carbide, aluminum oxide and titanium boride and cermets that include a ceramic of said group.

* * * * *